United States Patent [19]

Galinou

[11] 4,079,694

[45] Mar. 21, 1978

[54] APPARATUS FOR APPLYING A COATING TO A SUBMERGED SURFACE

[75] Inventor: Raymond Galinou, Veigne, France

[73] Assignees: Commissariat a l'Energie Atomique; Centre National pour l'Exploitation des Oceans, both of Paris, France

[21] Appl. No.: 746,009

[22] Filed: Nov. 30, 1976

[30] Foreign Application Priority Data

Dec. 1, 1975 France ..... 75 36724

[51] Int. Cl.[2] ..... B05C 1/12; B05C 11/02; B05D 1/40

[52] U.S. Cl. ..... 118/207; 118/108; 118/110; 118/259; 15/1.7; 15/50 C; 114/222

[58] Field of Search ..... 118/207, 259, 108, 110, 118/305; 15/1.7, 50 C, 230.11; 114/222

[56] References Cited

U.S. PATENT DOCUMENTS

| | | | |
|---|---|---|---|
| 2,118,276 | 5/1938 | Temple | 118/207 X |
| 2,411,842 | 12/1946 | Adams | 15/230.11 X |
| 2,624,914 | 1/1953 | Rhodes | 118/259 X |
| 3,638,600 | 2/1972 | Modrey | 114/222 |
| 3,707,737 | 1/1973 | Brower | 114/222 X |
| 3,766,879 | 10/1973 | Jones | 114/222 |
| 3,906,572 | 9/1975 | Winn | 114/222 X |
| 3,984,944 | 10/1976 | Maasberg et al. | 114/222 X |

OTHER PUBLICATIONS

Kirk-Othmer, Encyclopedia of Chemical Technology, 1970, Vol. 16, pp. 181, 182.

*Primary Examiner*—Wm. Carter Reynolds
*Attorney, Agent, or Firm*—Cameron, Kerkam, Sutton, Stowell & Stowell

[57] ABSTRACT

Apparatus for applying a coating to a submerged surface has a spreader for a coating on the surface to be coated in a progressive manner and during displacement of said spreader parallel to the surface. A given pressure is applied on the spreader to apply the same against the surface. The coating material is continuously supplied to the spreading means in such a way that the displacement of said spreading means forces the water from the surface and the simultaneous application to the surface of the coating.

18 Claims, 6 Drawing Figures

Figure 2:
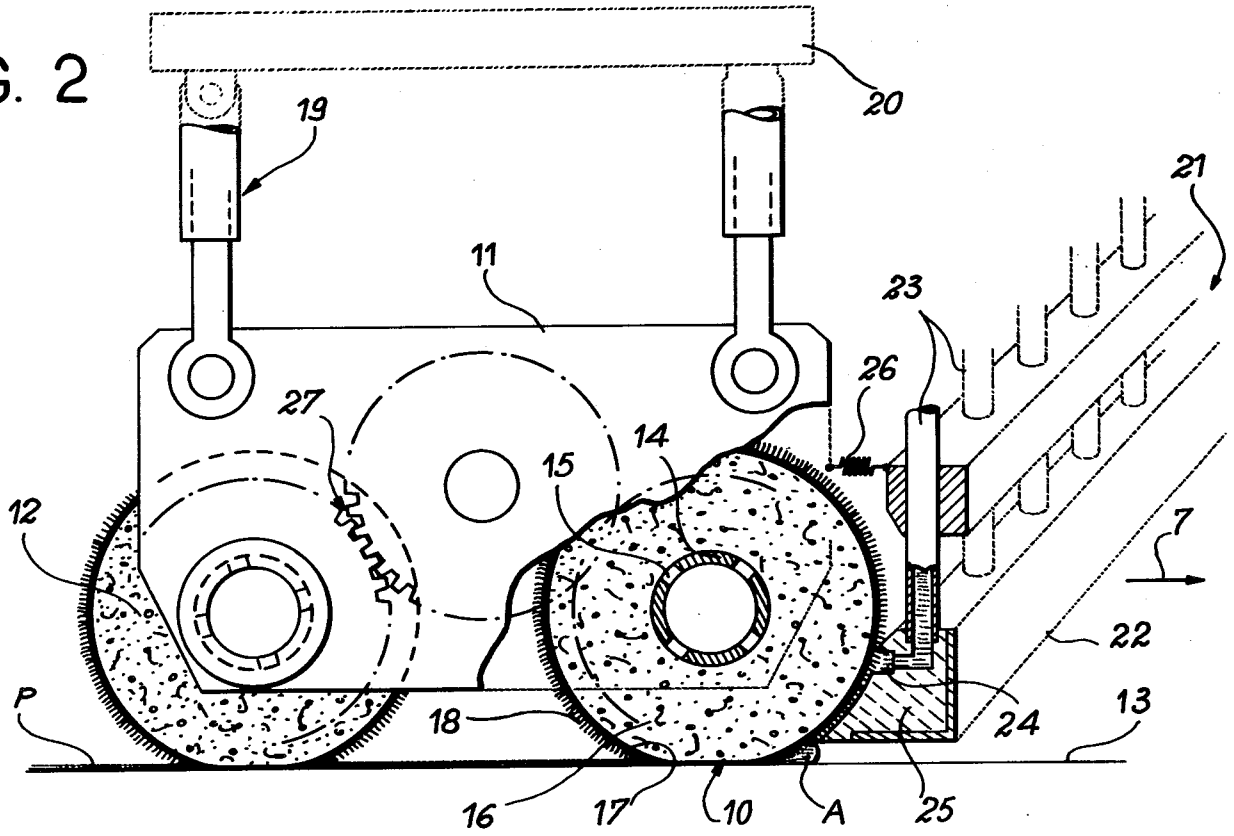

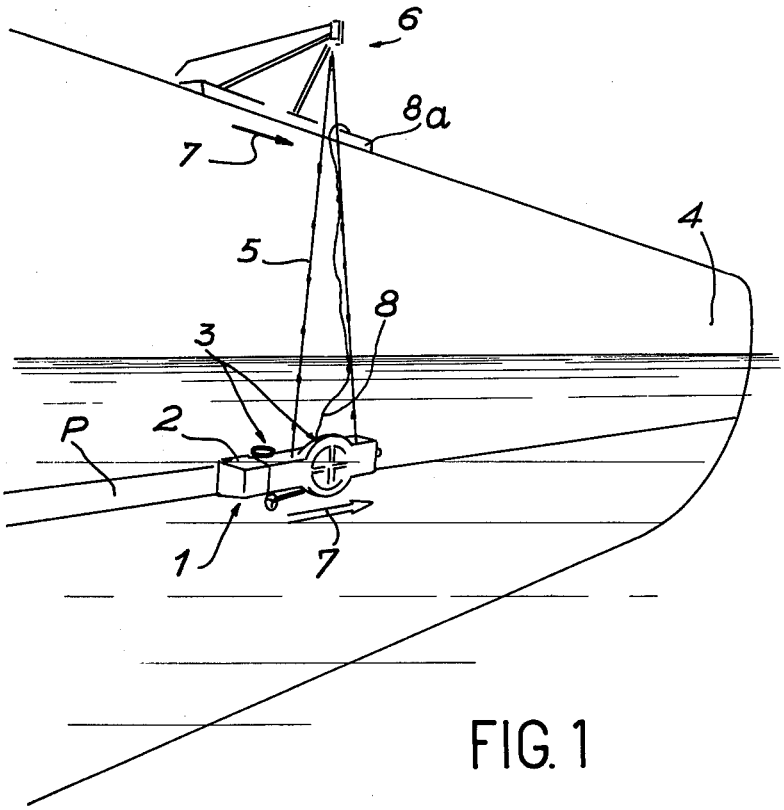
FIG. 1
FIG. 5
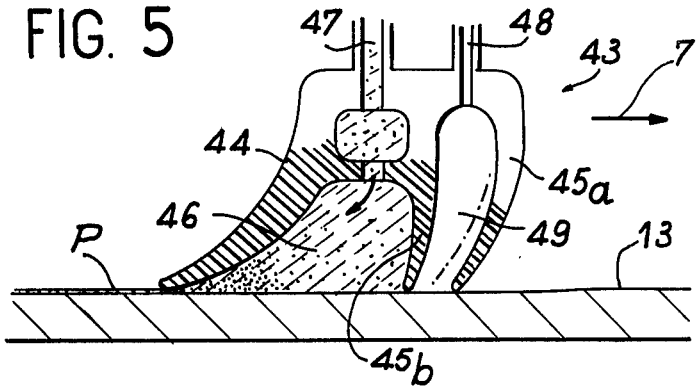

APPARATUS FOR APPLYING A COATING TO A SUBMERGED SURFACE

The present invention relates to an apparatus for applying a coating to a submerged surface and more particularly for the continuous underwater painting of a large surface such as, for example, the hull of a ship, the bases or piles of fixed structures, submerged structures, etc.

It is known that there are a certain number of practical problems involved in maintaining submerged surfaces, more particularly covering them with one or more layers of paint for protecting them against corrosion by sea water. One of the hitherto adopted solutions consists of carrying out manual re-touching using brushes, spatulas or rollers operated by underwater divers. In addition, a method is known which permits the cleaning and protective treatment of large surface areas both above and below the water level, said method involving the use of successive containers in which a sufficient vacuum is created to make it possible in the manner of a suction cup to maintain the apparatus against the surface to be treated, and apply the selected protective product thereto whilst sheltered from water, said surface being coated by means of spray guns or similar devices optionally combined with suitable rapid drying devices.

The object of the present invention is to provide an apparatus permitting the direct and continuous underwater application of a coating onto a surface and more particularly a perfectly smooth and adhesive coating of paint whilst permitting an adaptation to the most varied configurations of said surface, more particularly when the latter has irregularities, and an effective adhesion of said coating due to a judiciously adapted construction of the spreading means applied to the surface with a force independent of the submergence depth, said means also being designed in such a way that they produce a uniform spreading of the coating without any danger of significant dilution thereof with the surrounding water.

To this end, the apparatus is characterised in that it comprises means for spreading a coating on the surface to be coated in a progressive manner and under the action of the displacement of said means parallel to this surface, means for exerting a given pressure on the spreading means in order to apply the same against the surface and means for continuously supplying the coating material to the spreading means in such a way that the displacement of said spreading means causes the forcing back of the water from the surface and the simultaneous application to the latter of the coating.

Thus, the apparatus according to the invention makes it possible on the one hand to effectively expel the water from the surface to be coated and more particularly painted, and on the other hand to simultaneously apply a coating to the said surface. This leads to a very good adhesion of the coating, the latter being applied in a uniform manner and at all points of the surface to be coated, no matter what the displacement trajectory of the spreading means and no matter what local defects occur on the surface, whereby the latter can have a random slope relative to the horizontal or vertical plane.

According to a preferred embodiment of the invention, the means for spreading the coating onto the surface comprise a composite applicator having a sealed casing which in its outer wall is provided with flexible fibres or hairs for rubbing on the surface and which surrounds by its inner wall an elastic body having a non-sealed alveolar or honeycomb structure, whereby said applicator is associated with a rigid support cooperating with means exerting a given pressure on the surface.

According to a special feature, the rigid support has passage openings permitting the water outside the applicator to fill the cavities of the elastic body in such a way that the inner pressure is equal to the outer pressure, no matter what the submergence depth.

Preferably the means for exerting a given pressure on the surface comprise jacks or springs. It is also preferable for these jacks to be supported respectively on the rigid support, specifically on the frame of a movable trolley or on the means for spreading the coating carried by said frame, whereby the trolley is itself associated with displacement means on the surface to be coated, as well as means for maintaining the same at a given distance from said surface.

According to a first special embodiment, the applicator comprises at least one cylindrical roller having an axial supporting mandrel surrounded by the elastic body, itself contained in the sealed casing externally provided with flexible rubbing hairs. According to another variant, the applicator comprises a slide block having a supporting plate for the generally parallelepipedic flexible body surrounded by the sealed casing provided externally with flexible rubbing hairs.

Advantageously the elastic body of the applicator comprises a foam with open cavities and specifically a polyester type foam. It is also preferable for the rubbing hairs arranged on the outer wall of the sealed casing to be deposited by blocking and have dimensions and densities suitable for the type and final appearance of the coating and of the surface to be coated. Finally, and according to a preferred embodiment, the sealed casing surrounding the elastic body is made from polyurethane.

According to the invention, the sealed casing surrounding the elastic body prevents the coating material deposited between the surface to be coated and the applicator and applied against the surface by the rubbing hairs from mixing to any significant extent with water impregnating the roller which prevents the prejudicial dilution of the coating film deposited and spread over the surface during its application. Moreover, the elastic body is easily able to absorb surface defects during the displacement of the applicator against the same, and in particular is able to follow local variations of this surface by compression or expansion without having to modify the application pressure.

In the case where the applicator comprises a cylindrical roller the coating material is supplied by at least one distribution pipe positioned in front of the roller and sufficiently close to the latter to permanently form beneath the roller a coating wedge pressed between the surface and the roller in such a way as to prevent the water expelled by the roller pressure during the forward movement thereof from returning beneath the roller, whilst simultaneously permitting a uniform spreading against the surface. As a result of the special arrangements envisaged, the flexible rubbing hairs provided on the outside of the sealed casing gradually fill with the coating material to the right of the distribution pipe and permanently and repeatedly displace it towards the surface.

According to another feature, the distribution pipe is formed by an elongated bar extending parallel to and in front of the roller, said bar being connected to a multi-channel metering pump designed to supply the same quantity of coating material over the entire roller length. Preferably the bar is applied against the roller by springs exerting a slight pressure on the rubbing hairs. It is also preferable for the bar to be sub-divided into independent adjacent housings, each associated with a coating material supply tube.

In the second variant where the applicator comprises a slide block, the coating material is supplied by at least one distribution pipe traversing the elastic body and issuing into a recess beneath the slide block between the sealed casing and the surface. Preferably the distribution pipe is formed by a plurality of separate tubes each associated with a recess, said tubes being connected to a multi-channel metering pump. Finally, and according to a special feature, the apparatus can comprise a pivoting member equipped with a plurality of identical slide blocks which makes it possible to replace a worn slide block by a new slide block as a result of a rotary movement controlled by a hydraulic jack or the like.

According to another variant, the means for spreading the coating on the surface comprise at least one spatula having three flexible lips extending substantially perpendicularly to the displacement direction of the spatula, whereby the two lips located in front of the spatula define a cavity, whilst the two following lips form between them and on the surface a closed zone. The means for supplying the coating material comprise at least one supply pipe issuing into the said closed zone. The spatula is carried by the frame of a movable trolley, whereby the means for exerting a given pressure on the surface comprise springs which are supported on the one hand on the spatula and on the other hand on the frame. Finally, a gas jet issuing into the cavity between the first two lips in front of the spatula applies these lips to the surface by expelling the water towards the outside of the spatula.

No matter what variant is adopted for the means for spreading the coating, the means for maintaining the frame of the movable trolley at a given distance from the surface comprise a turbine integral with the frame, whereby said turbine exerts a suction force which engages the trolley with the surface. According to another feature, the members for moving the trolley on the surface comprise driving wheels driven by a motor carried by the trolley. Finally, in the variant where the spreading means comprise a cylindrical roller, the driving wheels are connected to said roller by at least one regulatable transmission member permitting the rotation of the roller on the surface during the movement of the movable trolley with a circumferential speed which is identical to or different from that of the driving wheels.

Figure 3:
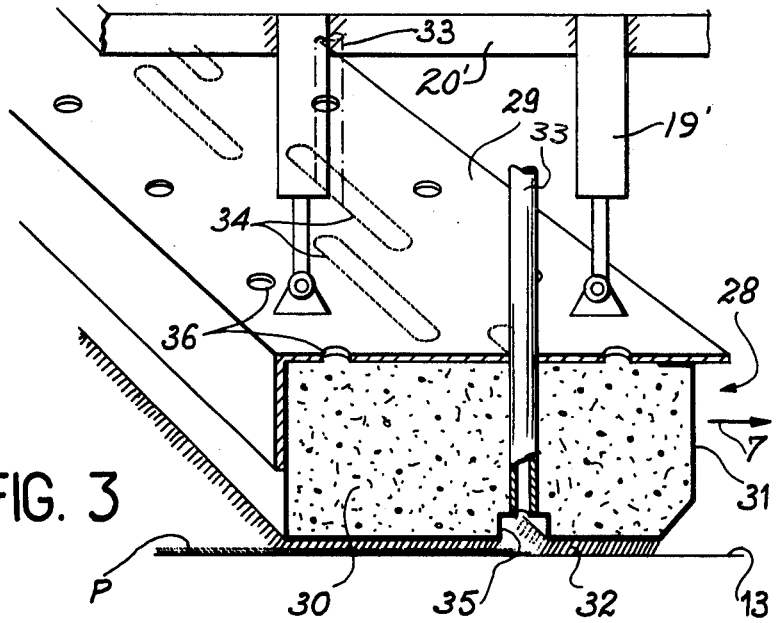
Figure 4:
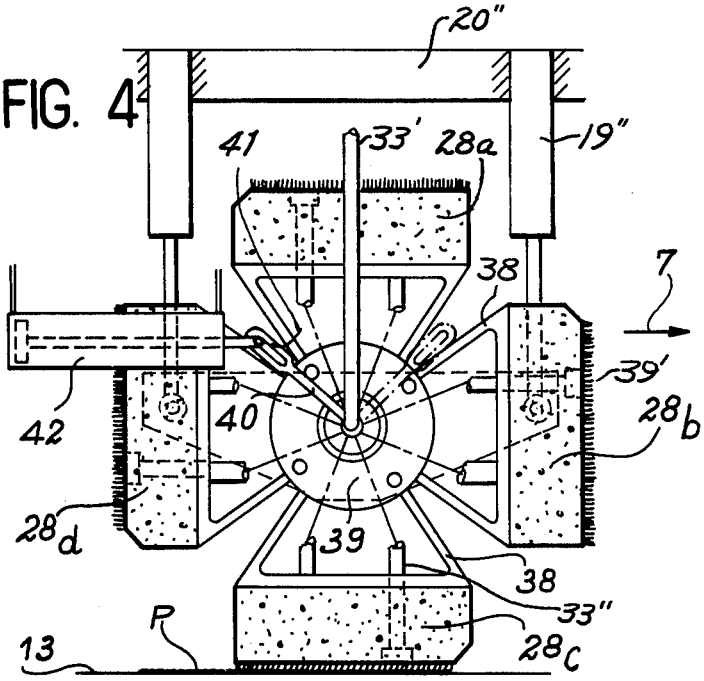
Figure 6:
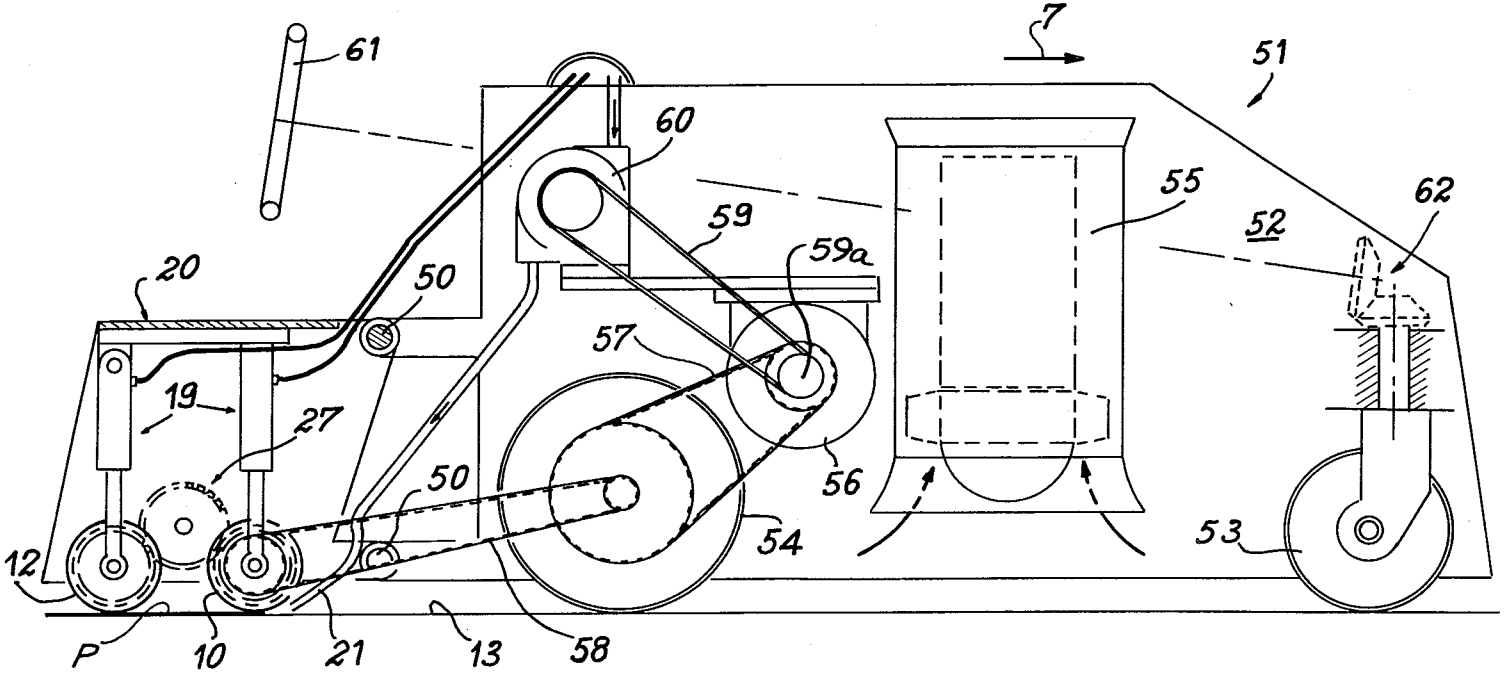

The invention will be better understood from the following description of various embodiments which are described in an explanatory and non-limitative manner with reference to the attached drawings, wherein show:

FIG. 1, an overall schematic and perspective view of an apparatus according to the invention, particularly adapted to painting the hull of a ship, whereof part is submerged in the water;

FIG. 2, on a larger scale, a section and partial perspective view of a first embodiment for the coating spreading means;

FIG. 3, another sectional perspective view of another embodiment;

FIG. 4, a schematic view illustrating a rotary means permitting the adaptation to the apparatus of several coating applicators according to FIG. 3 and which can be used successively;

FIG. 5, a third embodiment;

FIG. 6, a longitudinal overall section of the apparatus in its embodiment which uses as the coating spreading means the cylindrical rollers according to the embodiment illustrated in FIG. 2.

FIG. 1 shows the apparatus 1 for applying a coating of paint to the hull of a ship, said apparatus comprising a first portion 2 containing the coating spreading means and a second portion 3 with the means for controlling and displacing the spreading means against the surface 4 to be painted, whilst maintaining them applied against the latter. Apparatus 1 is lowered below water level by cables 5 connected to a crane 6 placed on the bridge of the ship, whereby the displacement along the hull is controlled by a not shown means. The direction of movement of apparatus 1 is shown by arrow 7. The spreading means 2 are supplied with paint by a flexible pipe 8 connected to a paint tank **8*a*** placed on the bridge. The area which has already been painted during the displacement of the apparatus is shown as P.

FIG. 2 illustrates a first embodiment of the means permitting the spreading of the coating on the surface whilst simultaneously ensuring the displacement of these means and whilst exerting thereon a given application pressure against said surface, with a view more particularly to expelling the water just prior to spreading the coating material.

In this first embodiment the apparatus uses a first applicator roller 10 carried by a frame 11, said first roller being followed by a second roller 12 of the same type and dimensions as the first roller 10 and which serves more particularly to smooth the paint coating P deposited on the surface 13 to be coated. Roller 10 has an axial supporting mandrel 14 with openings 15 and about which is placed an elastic body 16 made from a material having open cavities and more particularly a polyester foam. The presence of the openings 15 makes it possible for the surrounding water which fills mandrel 14 to penetrate the cavities of the foam body 16, thus maintaining within the latter an internal pressure which is permanently equal to the external pressure, whilst becoming independent of the forces which could result from a non-uniform variation of the pressures with the submergence depth of the apparatus.

The elastic foam body 16 is externally surrounded by a sealed casing 17 on the outer surface of which are placed flexible rubbing fibres or hairs 18 whose density, length and distribution are adapted to the nature of the coating material used and the state of the surface to be coated. Advantageously, the rubbing hairs are deposited by flocking onto the sealed casing or skin 17 with variable densities and dimensions according to the nature of the coating, whereby flocking with short dense hairs makes it possible to obtain a better appearance than in the case of longer hairs due to the greater smoothing of the coating material. In the conventional case where this material comprises a paint, the polyester foam constituting the elastic body 16 is selected in such a way that it is compatible with the paint used and more particularly with the solvents contained therein. Finally, the thickness of the body is selected so as to be sufficient to permit the rollers to appropriately absorb defects on surface 13 and more particularly local variations in the latter so that they can permanently follow its profile without having to modify the application force exerted by the jacks 19 supported on the one hand on frame 11 and on the other on a plate 20 belonging to the housing of the apparatus. As a variant, the jacks can exert the application force on the surface by acting directly on the spindles of rollers 10 and 12.

Advantageously, the sealed casing 17 surrounding the flexible body comprises a polyurethane envelope which prevents the water which impregnates the elastic body from mixing from within with the coating material fed in front of the roller by means of a suitable distribution means, 21.

In the embodiment considered, this distribution means can in particular comprise an elongated bar 22 extending parallel to the spindle of roller 10 and located in front of the latter, whereby said bar supports a series of supply tubes 23 bent at their lower ends and having spray nozzles 24 positioned in the immediate vicinity of the rubbing hairs 18 of the roller. Bar 22 forms in front of it a type of shoe 25 which is applied against the roller by means of springs 26 permitting a slight pressure on the part of the distribution means 21 to be exerted on the rubbing hairs.

In operation, the coating material supplying the tubes 23 of bar 22 by a multi-channel metering pump (not shown) is supplied in front of roller 10 at a suitable distribution pressure, whereby the hairs 18 of the roller pass this material towards the surface 13 by forming between the latter and the roller a fluid wedge A simultaneously bringing about the expulsion of the water from the surface in front of the roller and the application and spreading of the paint on the said surface. The placing of a sealed casing 17 around the roller in accordance with the present invention makes it possible in this process to avoid external water from mixing with the coating material whilst ensuring a more effective application of the latter and finally a better adhesion thereof to the surface. Moreover, the sealed casing 17 prevents the coating material from being absorbed by the elastic foam which would prevent the formation of wedge A.

The second roller 12 which is identical to the first roller 10 in turn ensures the equalising and smoothing of the coating whilst eliminating any deficiencies. It should also be noted that the two rollers 10 and 12 are preferably synchronously driven by a set of gears 27 connected to the drive means of the apparatus against surface 13 as will be shown hereinafter with regard to FIG. 6. Optionally rollers 10 and 12 can be driven at a different speed to that of the driving wheels so as to permit the said rollers to slide on the coating applied to the surface and a better facing of the latter.

FIG. 3 is a detailed view of another embodiment where the applicator of the coating to surface 13 comprises a slide block 28 having an upper rigid supporting plate 29 on which is exerted by any appropriate means such as jacks 19' supported on plate 20' of the housing, springs etc. a suitable application force against the surface. Plate 29 supports a substantially parallelepipedic elastic body 30 partially surrounded by a sealed casing 31, itself provided on its outer surface adjacent the surface to be coated with flexible rubbing hairs or fibers 32. Preferably the elastic foam body, the sealed casing and the rubbing hairs are produced in the same way as described relative to the first embodiment with regard to FIG. 2.

In the present embodiment using a slide block the coating material is distributed by means of a series of tubes 33 traversing slide block 28 and issuing into oblong slots 34 which are suitably distributed over body 30, said slots in turn issuing beneath body 30 into recesses 35 which are open on the side of the surface 13 to be coated. The coating material, particularly paint, is thus brought from an exterior source (not shown) into contact with the surface and deposited thereon proportionately with the displacement of the slide block, whereby the rubbing hairs 32 located to the rear recesses 35 relative to the displacement direction indicated by arrow 7 make it possible to spread the paint uniformly on the surface. Moreover, the hairs 32 located in front of these recesses ensure the removal of water prior to the application of the coating, the application pressure provided by elastic body 30 and sealed casing 31 prevent said water from coming into contact with the paint over the entire area in which the slide block works. The coating material contained in recesses 35 forms a sealed band over the entire width of the slide block so that water cannot enter the area located downstream of recesses 35 relative to the displacement direction of the slide block. It should be noted that as in the previous embodiment supporting plate 29 has openings 36 permitting the external water to fill the cavities of foam 30 in order to keep the internal and external pressures identical.

FIG. 4 shows an ancillary device which in the case of the embodiment using slide blocks makes it possible to immediately replace a worn slide block by a new slide block without it being necessary to disassemble the apparatus. To this end the device comprises four slide blocks **28*a*, 28*b*, 28*c* and 28*d* each carried by supports 38 integral with a rotary means 39 which can be operated by levers 40 which have at their ends eyelets 41 for connection purposes with the rod of a hydraulic jack 42. Rotary means 39 are mounted in frame 39' in turn carried by jacks 19'' supported by plate 20'' of the housing. An indicator of the wear of the rubbing hairs of each not shown slide block starts the operation of substituting one block by the other. The slide blocks are held to the surface by appropriate force applied by jacks 19''**.

Pipe 33' connecting to branches 33'' continuously supplies coating material to the slide block engaging the surface to be coated, here block **28*c***.

FIG. 5 shows a third embodiment of the spreading means in which the apparatus comprises a spatula 43 having three flexible lips 44, **45*a* and 45*b*. A cavity 49 is formed between lips 45*a* and 45*b*. Moreover, the two lips 44 and 45*b* define between them and surface 13 to be coated a closed zone 46. Paint is supplied by a pipe 47 which issues into zone 46. The means for applying the pressure necessary for ensuring a good spreading of the paint and the expulsion of the water from the surface to be coated are ensured on the one hand by not shown springs which are supported on the frame of the movable drive trolley (also not shown), as well as by a gas jet introduced by a pipe 48 into the hollow portion 49 between lips 45*a* and 45*b***.

Finally, FIG. 6 shows an overall view of a preferred embodiment of the apparatus according to the invention in which the spreading means comprise cylindrical rollers 10 and 12 like those described in connection with the embodiment of FIG. 2. FIG. 2 shows the plate 20 of the housing on which is supported jacks 19 which exert either on frame 11 or directly on the spindle of these rollers the necessary application pressure against the surface to be coated. Plate 20 is also connected by couplings 50 to a self-propelling assembly 51 which itself has means for keeping it at a given distance from surface 13 whilst at the same time moving it along the said surface. Assembly 51 mainly comprises a movable trolley 52 having a plurality of wheels 53, 54 and a turbine 55 which, as a result of the suction force created by the latter makes it possible to engage the trolley against surface 13. Turbine 55 is of a structure which is well known and includes in general an axial propeller of the general type of a marine propeller for example with three blades. This propeller is surrounded by an exterior housing which protects it and as indicated by the arrows in FIG. 6 permits the propeller to draw water through the housing causing a reaction with respect to the wall and a force to be exerted against assembly 51. The propeller can be rotated by any suitable control motor, for example an internal combustion engine such as an outboard engine or by a hydraulic motor driving the propeller at a suitable speed on the order of 1200 rpm. Structure 55 is therefore not a true turbine in the usual sense but utilizes a system as in a turbine of a propeller and a surrounding housing. Trolley 52 supports a hydraulic or explosion marine engine which via a reverse belt 57 operates the rear wheels 54, whereby the movement of these driving wheels is transmitted by another belt 58 to roller 10. A main drive pinion 59*a* on motor acting through belt 59 controls in parallel a multi-channel pump 60 which supplies paint to the distribution tubes 21 to supply the same quantity of coating material over the length of the roller 10. A steering wheel 61 transmits commands via a return member 62 to the guide wheels 53 in front of the trolley.

In this way a simple apparatus is obtained permitting the depositing of a random coating and more particularly paint on a surface, and more particularly a submerged surface, whereby said apparatus has remarkable advantages. Paint is supplied continuously from the outside of the applicators, the latter being designed so as to displace the water as the coating is applied. In the case of cylindrical rollers or slide blocks the latter are completely sealed on their outer casing, whilst their construction by means of elastic foam means that they do not suffer from the variations in the external pressure which occur as the submergence depth changes, instead they faithfully follow changes in the surface profile. Finally, the apparatus according to the invention can be used continuously and automatically on large surface areas having a random slope relative to the horizontal or vertical, whereby the coating thickness can be predetermined and permanently controlled. It should be noted that the embodiment using slide blocks leads to a very simple mechanical assembly with no turning or oscillating parts.

Obviously the invention is not limited to the embodiments specifically described and represented hereinbefore and in fact covers all variants thereto. It should be particularly noted that the coating applicator can be constructed by combining on the supporting frame a roller and a slide block or a plurality of the said members.

What is claimed is:

1. An apparatus for applying a coating to a surface submerged in water comprising means for progressively spreading a coating on the surface to be coated upon displacement of said means parallel to this surface, means for exerting a given pressure on said spreading means to apply said spreading means against the surface, means for continuously supplying a coating material to said spreading means in such a way that the displacement of said spreading means forces the water from the surface and the simultaneous application to the surface of said coating material, said means for spreading said coating material onto the surface comprising a composite applicator having a sealed casing, an outer wall for said casing, flexible fibres on said wall for rubbing on the surface, an inner wall for said casing, an elastic body at least partially surrounded by said inner wall having a non-sealed honeycomb structure, said applicator being associated with a rigid support cooperating with said means for exerting a given pressure on the surface, said rigid support having openings permitting the water outside said applicator to fill cavities of said elastic body and equalize pressure within and outside of said applicator no matter what the submergence depth.

2. An apparatus according to claim 1, wherein said applicator comprises at least one cylindrical roller, said rigid support being an axial supporting mandrel for said roller surrounded by said elastic body, and contained in said sealed casing and externally supporting said flexible fibres.

3. An apparatus according to claim 1, wherein said applicator comprises a slide block having a supporting plate for said elastic body, said elastic body being a generally parallelepipedic flexible body partially surrounded by said sealed casing externally supporting said flexible fibres.

4. An apparatus according to claim 1, wherein said elastic body is a polyester foam.

5. An apparatus according to claim 1, said flexible fibres are deposited on said sealed casing by flocking with variable densities and dimensions according to the nature of the coating.

6. An apparatus according to claim 1, wherein said sealed casing is polyurethane.

7. An apparatus according to claim 2, wherein the coating material is fed to a front of said cylindrical roller by at least one distribution pipe in front of said roller and so close to said roller that beneath said roller is permanently formed a coating wedge pressed between the surface and said roller.

8. An apparatus according to claim 7, wherein said distribution pipe includes an elongated bar extending parallel to and in front of said roller, said bar being connected to a multi-channel metering pump to supply the same quantity of coating material over the entire length of said roller.

9. An apparatus according to claim 8, wherein said bar is applied against the roller by springs exerting a slight pressure on said fibres.

10. An apparatus according to claim 8, wherein said bar is subdivided into independent adjacent housings, each of said housings being associated with a coating material supply tube.

11. An apparatus according to claim 2, wherein said cylindrical roller is driven at a speed which differs from the speed of its displacement on the surface.

12. An apparatus according to claim 3, wherein said coating material is supplied to said slide block by at least one distribution pipe opening into a recess beneath said slide block, between said sealed casing and the surface.

13. An apparatus according to claim 12, wherein said distribution pipe comprises a plurality of separate tubes each associated with said recess beneath said slide block, said tubes being connected to a multi-channel metering pump.

14. An apparatus according to claim 3, including a pivoting member and a plurality of said slide blocks mounted on said member whereby a worn slide block is replaced by a new slide block by rotation of said member and a hydraulic jack for rotating said member.

15. An apparatus according to claim 1, wherein said means for exerting a given pressure on said spreading means comprise jacks or springs.

16. An apparatus according to claim 1, wherein said means for spreading the coating are carried by a movable trolley, guide wheels operated by a steering wheel and driving wheels for said trolley and a motor supported by said trolley driving said drive wheels.

17. An apparatus according to claim 16, wherein said drive motor for said driving wheels rotates said applicator roller through a main drive pinion and a return member.

18. An apparatus according to claim 16, wherein said trolley supports a turbine producing a suction force to engage said trolley with the surface to be coated during displacement of said trolley.

* * * * *